United States Patent [19]

Kolonia

[11] Patent Number: 4,841,597

[45] Date of Patent: Jun. 27, 1989

[54] INTERCHANGEABLE HAND TOOL AND HANDLE THEREFOR

[76] Inventor: Robert A. Kolonia, R.D. 3, Agnes Rd., Box 318, Milford, N.J. 08848

[21] Appl. No.: 894,568

[22] Filed: Aug. 8, 1986

[51] Int. Cl.[4] ..... B25G 1/10; B25G 3/00

[52] U.S. Cl. ..... 16/114 R; 16/DIG. 18; 16/DIG. 24

[58] Field of Search ..... 16/114 R, 108, 110 R, 16/109, DIG. 18, 111 R, DIG. 24, DIG. 41; 403/267, 266, 265, 330, 361, 325, 108; 81/22, 177.2, 491; 273/81 R, 81.2, DIG. 3, DIG. 12; 294/57

[56] References Cited

U.S. PATENT DOCUMENTS

| | | | |
|---|---|---|---|
| 1,331,806 | 2/1920 | Curtis | 16/108 |
| 1,530,225 | 3/1925 | Belakoy | 294/57 X |
| 3,211,198 | 10/1965 | Glasgow | 403/361 |
| 3,770,033 | 11/1973 | Gavillet | 81/22 |
| 4,050,727 | 9/1977 | Bonnes | 16/110 R |
| 4,466,377 | 8/1984 | Kolb | 16/114 R |
| 4,570,988 | 2/1986 | Carmien | 294/57 |
| 4,593,430 | 6/1986 | Spangler | 16/DIG. 41 |
| 4,639,029 | 1/1987 | Kolonia | 294/57 |

FOREIGN PATENT DOCUMENTS

| | | | |
|---|---|---|---|
| 127338 | 8/1900 | Fed. Rep. of Germany | 16/109 |

*Primary Examiner*—Fred A. Silverberg
*Attorney, Agent, or Firm*—Neil F. Markva

[57] ABSTRACT

The hand tool has an interchangeable handle member with a particular coupling mechanism. The tool comprises a tool member fixedly disposed at one end of a ferrule member having a socket portion open to receive the tool end section of the handle member. The handle member includes the tool end section at one end thereof and a hand gripping section toward the other end thereof. The tool end section is elongate and extends into the socket portion and includes an outer surface having an inner end and an outer end. A shock absorbing mechanism is located intermediate the inner and outer ends of the tool end section along the outer surface thereof. The shock absorbing mechanism is effective to provide a tightened fit between the ferrule member and the tool end section when the ferrule member is slidingly displaced over the outer surface of the tool end section. While the coupling mechanism between the tool end section and the ferrule member is adaptable to any type of handle, the specific embodiment includes a composite structure having a core member with a molded plastic outer coating over the core member. The hand gripping section is oval-shaped in cross-section with the major axis thereof in a plane which extends through the longitudinal central axis of the handle member and thereby extends symmetrically through a tool disposed thereon. A particular connecting assembly including a fixture used in combination with a shank portion of a tool is used to fixedly disposed the tool in an outer working end of the ferrule member.

31 Claims, 2 Drawing Sheets

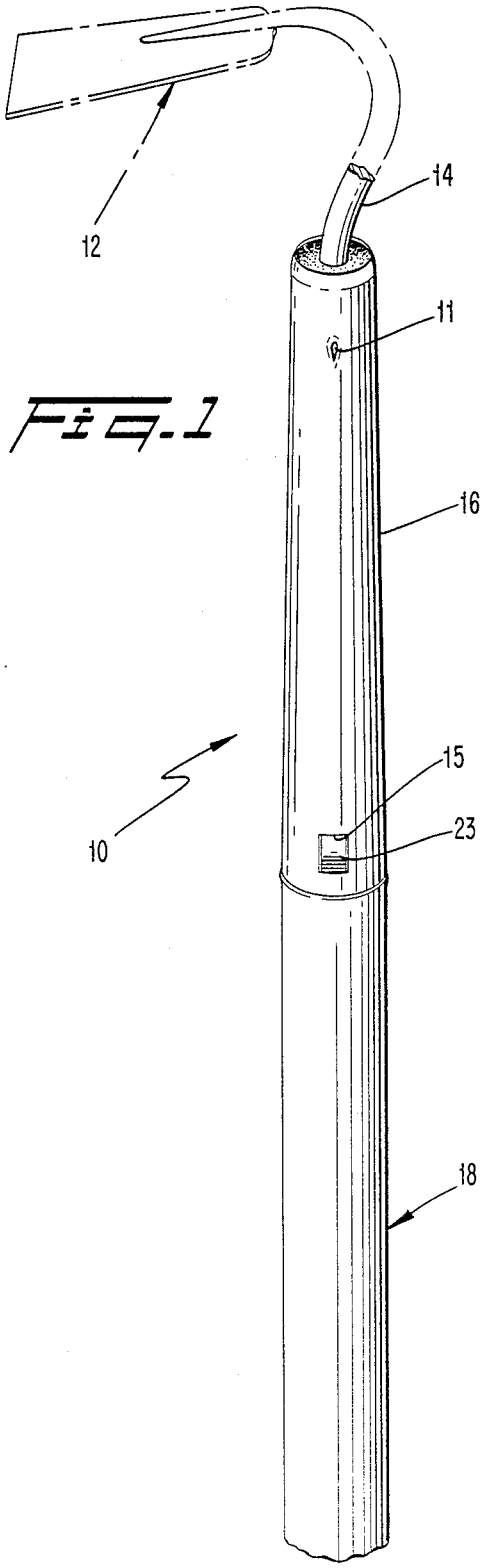
Fig. 1
Fig. 2
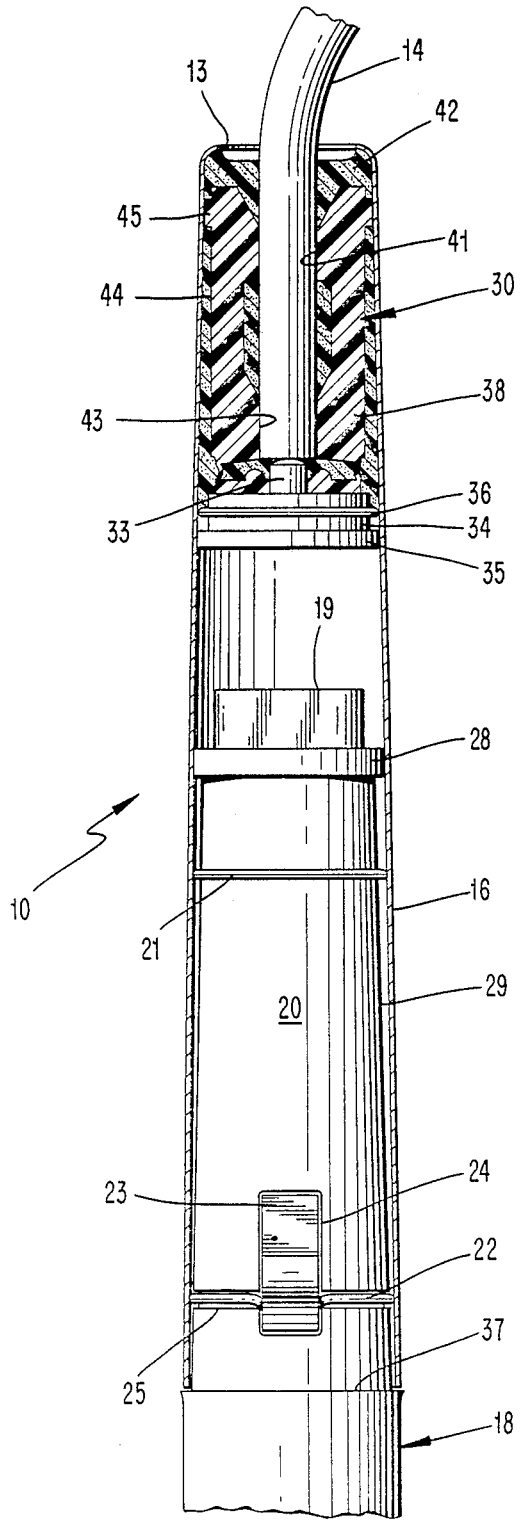

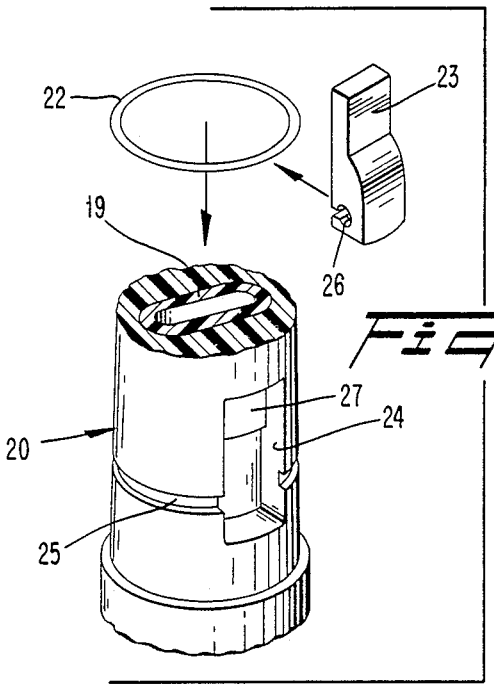
Fig. 4
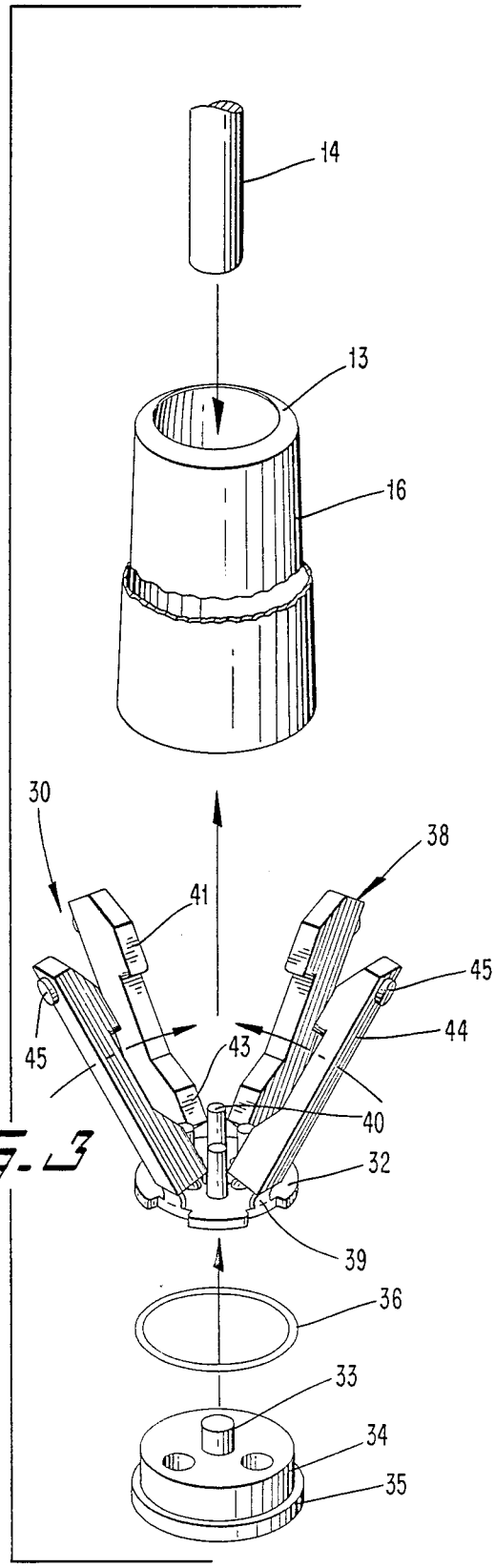
Fig. 3
Fig. 5
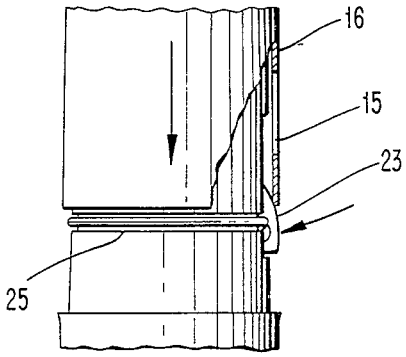
Fig. 6
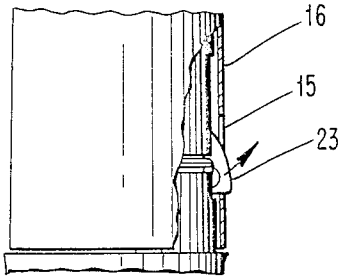

INTERCHANGEABLE HAND TOOL AND HANDLE THEREFOR

FIELD OF THE INVENTION

This invention relates to interchangeable hand tools and a handle structure for such tools as garden tools including shovels, rakes, hoes, pitch forks and the like and for such things as brooms, paint brushes and rollers, cutting tools and the like. More particularly, the invention is directed to a particular coupling mechanism for attaching tool members to a tool handle.

BACKGROUND OF THE INVENTION

Interchangeable tools and tool handles are known. Particular types of molded handles for tools having a core member are also known as typified by U.S. Pat. No. 3,770,033.

While the use of plastic materials to form handles for various types of tools such as garden tools has been suggested by the prior art, none has ever been produced nor made readily available except by the inventor himself. Such tools generally have wood handles that are circular in cross-section to fit into circular shanks and sleeves used as part of the well known tool structures. All wooden tool handles are easily shaped into a circular cross-section starting with an elongated wood blank having a rectangular cross-section While it is known to use plastic as a substitute for wood in tool handles generally, the production of molded plastic handles for hand tools such as garden tools presents unique problems. The density of high impact, injection molded plastic is much greater than wood. Thus, weight considerations are very significant particularly because there is a certain flexibility, tensile strength and impact strength that must be maintained to achieve the desired results. The inventor himself has developed a significantly new gripping structure of a hand tool as set forth in his co-pending U.S. patent application Ser. No. 764,125 filed Aug. 9, 1985 now U.S. Pat. No. 4,639,029, with its written description being specifically incorporated by reference herein.

The known types of interchangeable hand tools generally have relatively complex and expensive coupling means for attaching the tool member to the tool end section of a handle. The particular prior art configuration provides no mechanism for adjusting the tightness of the fit between the removable tool structure with respect to the tool handle. Furthermore, the prior art structure used with known interchangeable tool handles can wear out rather quickly after use and provide a loose fit over the end of the tool handle. Such a loose fit increases the significance of the wear while the tool is in use.

PURPOSE OF THE INVENTION

The primary object of this invention is to provide an interchangeable hand tool that incorporates a very simple coupling mechanism which is adjustable to the desired use conditions.

Another object of the invention is to provide an interchangeable tool handle with a specific structure allowing the user to maintain the tool in place on the end of the handle for extensive periods of time without the loosening thereof.

A still further object of the invention is to provide an interchangeable tool handle whereby the shock of use is absorbed by a shock absorbing mechanism specifically designed to enhance the fit of the tool member onto the end of the tool handle.

SUMMARY OF THE INVENTION

The hand tool of the present invention has an interchangeable handle member including a tool end section at one end thereof and a hand gripping section toward the other end thereof. The tool member is fixedly disposed at one end of a ferrule member. The ferrule member includes an open socket portion which receives the tool end section of the handle member. The tool end section is elongate to extend into the socket portion and includes an outer surface having an inner end and an outer end. Shock absorbing means located intermediate the inner and outer ends of the tool end section along the outer surface is effective to provide a tightened fit between the ferrule member and the tool end section when the ferrule member is slidingly displaced over the outer surface of the tool end section.

The shock absorbing means comprises first compressible ferrule contacting means located along an inner end portion of the tool end section and a second compressible ferrule contacting means laterally spaced from the first compressible ferrule contacting means toward the outer end of the tool end section. An inner end portion of the tool end section is in slip fit contact with an outer end portion of the ferrule member.

The shock absorbing means may also be described as having a compressible ferrule seating means located on the outer surface at an inner end portion of the tool end section and a compressible ferrule tightening means adjustably disposed at a location laterally displaced from the seating means toward the outer end of the tool end section. The compressible ferrule tightening means may include a resilient ring member movable along the outer surface of the tool end section. An outer end abutment means located at the end of the tool end section maintains the ring member on the tool end section. In a specific embodiment, the outer surface of the tool end section tapers inwardly toward the outer end thereof and thereby forms a conically shaped tool end section with the outer abutment means comprising a circumferential flange located at the outer end thereof.

In the specific embodiment, the shock absorbing means comprises first and second resilient ring members consisting of O-rings composed of compressible material. The first resilient ring member is disposed in a circumferential groove formed in the outer surface of the tool end section and acts as a seating means at an inner end portion thereof. The second resilient ring member is disposed along the tapered tool end section and constitutes an adjustable tightening means.

Another feature of the invention is directed to the use of a releasable locking means including a manually actuatable member to release the ferrule member for removal of the ferrule member from the tool end section. The ferrule member includes an aperture and the actuatable member comprises a button element biassed outwardly from the outer surface of the tool end section to protrude through the aperture when the aperture is registered over the button element once the ferrule member is in a final operating position over the tool end section. In a specific embodiment, the button element is movably disposed in an elongate recess formed in the outer surface of the tool end section. The biassing means is located on the tool end section to urge one end of the button element outwardly with respect to the tool end section. In a specific embodiment, an O-ring is located in a circumferential groove and spans the elongate recess. The button element has one end thereof attached to the spanning O-ring which urges the one end of the button element outwardly from the outside surface of the tool end section.

In another feature of the invention, the ferrule member includes tool member securing means located at the outer end of the ferrule member to fixedly hold the tool member in place. The tool member securing means includes a fixture assembly for centering a shank portion of the tool member and adhesive means disposed around the fixture and shank portion within the ferrule member. Mechanical locking means including projections from the inside surface of the ferrule member holds the adhesive material in place once it has changed from a liquid to a hardened condition.

The particular manner of attaching the tool member to a ferrule member presents a unique opportunity for the do-it-yourself person to literally construct an interchangeable tool by himself. The ferrule member, fixture assembly and tool having a shank portion may be provided along with a supply of adhesive material such as epoxy resin. With the various parts being supplied separately, it is then simply a matter of the fixture assembly being inserted into the ferrule through the open socket portion and the shank portion being inserted into the fixture assembly. Once the assembly is firmly in place at the outer end of the ferrule member, the adhesive material may then be poured into the open outer end and allowed to harden. Once that assembly is complete, it may then be placed over the handle member as it has been developed according to the present invention.

The specific embodiment of the fixture assembly includes a base, a plurality of leg elements pivotally attached to the base and guide means for setting the location of the leg elements in an upright position with respect to the base. Each leg element has a tool shank facing surface directed inwardly toward a longitudinal axis thereof and a ferrule facing surface directed outwardly away from the longitudinal axis. The leg elements are effective to maintain a tool shank portion in a center position with respect to the ferrule member. The base member has an abutment surface means for contacting a free end surface of a tool shank portion when the shank portion is inserted along the longitudinal axis. The base includes a circumferential surface and sealing means is disposed along the circumferential surface to prevent fluid adhesive material from leaking between the base and the ferrule member when the fixture assembly is in an operative position in the ferrule member for receiving a tool shank portion therein.

The hand tool handle has a particular coupling mechanism for placing a tool including a ferrule member having a socket portion open at one end thereof, onto the end of the tool handle.

The tool handle is set forth with specific types of shock absorbing means as discussed above. The tapered outer surface of the tool end section is substantially circular in cross-section to form a conically shaped portion along the tool end section ending at the circumferential flange. The inner end of the tool end section is defined by a circumferential shoulder against which shoulder the ferrule member abuts when the ferrule member is in a final operating position along the outer surface.

The handle member of the specific embodiment comprises a composite structure including a core member having a molded plastic outer coating over the core member. The hand gripping section is oval-shaped in cross-section with the major axis thereof in a plane which extends through the longitudinal central axis of the handle member and thereby extends symmetrically through a tool disposed thereon. The core member is hollow and has an outer wall with a substantially uniform thickness around the entire periphery of the cross-section thereof and is composed of a strand material encased in a resinous material.

BRIEF DESCRIPTION OF DRAWINGS

Other objects of this invention will appear in the following description and claims, reference being made to the accompanying drawings forming a part of the specification wherein like reference characters designate corresponding parts in the several views.

FIG. 1 is a fragmentary perspective view of a hand tool made in accordance with this invention and shown in an assembled condition;

FIG. 2 is a fragmentary view, partly in section, of a hand tool showing a ferrule member and tool end section made in accordance with the invention;

FIG. 3 is a fragmentary, exploded view of a tool securing assembly according to the invention;

FIG. 4 is a fragmentary, exploded view, partly in section, showing a releasable locking mechanism according to the invention;

FIG. 5 is a fragmentary elevational view, partly in section, of a locking mechanism while the ferrule member is approaching a final operating position;

FIG. 6 is a fragmentary elevational view, partly in section, of the locking mechanism of FIG. 5 with the ferrule member in a final operating position.

DETAILED DESCRIPTION

The hand tool, generally designated 10, includes a tool member 12, a hoe in this embodiment, having a shank portion 14 fixedly disposed in the outer end of a ferrule member 16. The combination of the tool member 12 and ferrule member 16 is slidingly displaced over the tool end section 20 of the handle member 18. The button element 23 is biassed outwardly through the opening 15 of ferrule member 16.

Ferrule member 16 is slidingly displaced over the tool end section 20 which has a tapered surface 29 which tapers inwardly toward the outer end of tool section 20 as shown. An outer circumferential flange 28 is located at the outer end of the tool end section to hold the movably disposed O-ring 21 onto the tool end section 20. A further O-ring 22 is located in a circumferential groove 25 and acts as a seating means for the ferrule 16 at the inner end portion of the tool end section 20.

O-ring 21 is movable along tapered surface 29. The closer ring 21 comes to the top of the taper, the tighter ferrule member 16 fits on tool end section 20. Thus, the tightness of fit for ferrule member 16 may be adjusted by adjusting the position of ring 21 along surface 29 before ferrule member 16 is fitted over tool end section 20. As ferrule member 16 is slidingly displaced onto tool end section 20, ring 21 rolls along tapered surface 29 thereby approaching the inner end of tool end section 20 and becoming more compressed.

The elongate button 23 includes a ring coupling slot 26 which fits over the ring 22 which spans the elongate recess 24 located in the outer surface of the handle 18. The inner end of button element 23 is disposed contiguously to the rest surface 27 which is raised above the outer surface of the core member 19 as shown in FIG. 4. With the outer end of the button element releasably connected to the spanning O-ring 22, it is outwardly biassed to project through the aperture 15 of ferrule 16 once the ferrule member 16 is in place as shown in FIG. 6. In this embodiment, the width of the button element projected through the aperture 15 is ⅜ of an inch wide and about 7/8 of an inch long. The tool end section is about 4¼ inches long with the ferrule member being about 8 inches long. The shank portion 14 extends into the outer, end of the ferrule member 16 for a distance of between 2½ to 3 inches in this specific embodiment.

The handle member 18 is a composite structure having an injection molded plastic material formed as an outer coating over the core member 19. The plastic in this embodiment is polypropylene. The core member 19 is hollow and has an outer wall with a substantially uniform thickness of about ⅛ of an inch around the entire periphery of the cross-section thereof. Core member 19 is composed of a strand material encased in a resinous material with the strand material being fiberglass.

The shank portion 14 of tool 12 is fixedly disposed in the outer end of ferrule member 16 via the adhesive material 42 which is shown in a hardened condition. A fixture assembly is first introduced from the open socket portion of the tapered ferrule member 16. Once the fixture 30 is in place, the shank portion 14 is inserted into the opening formed by the outer flange 13 as far as the hub, shank seat member 33.

The fixture assembly 30 is composed of polypropylene and includes a base 32, a plurality of leg elements 38 and guide posts 40. The leg elements 38 are pivotally attached to the base member 32 via hinge elements 39. The guide posts 40 are placed on the base member 32 for disposition on each side of the leg elements 38 so that the elements are set in their location in an upright position with respect to the base 32 when the assembly 30 is inserted into the open socket portion end of ferrule member 16.

Each leg element 38 has a tool shank facing surface including an upper portion 41 and a lower portion 43. The elements 38 also include ferrule facing surfaces 44 which are directed outwardly away from the longitudinal axis of each ferrule member 16. Spacer projections 45 on the ferrule facing surfaces 44 enable the fixture element to adjust to all the tolerances which may appear with respect to the ferrule members into which the fixtures are placed in combination with the shank portion 14. With the spacing members 45 and the undercut inner surfaces of leg elements 38, the amount of liquid adhesive material such as epoxy resin 42 is maximized so that optimum holding conditions can be achieved.

The circumferential surface 34 carries an O-ring 36 sealingly engaged with the inner surface of ferrule 16. The flange 35 prevents the O-ring 36 from moving off the fixture 30.

The mechanical locking means includes projections 11 which extend inwardly from the inner surface of ferrule member 16 toward its longitudinal axis. This is particularly useful where the inside surface of the ferrule is tapered and the epoxy resin material 42 is allowed to harden from its liquid state thereby fixedly setting around the inwardly directed projections 11. As shown, the inner end of the tool end section 20 is defined by the shoulder 37.

While the interchangeable hand tool and handle therefore has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A hand tool having an interchangeable handle member, said tool comprising:

(a) a tool member fixedly disposed at one end of a ferrule member, (b) the handle member including a tool end section at one end thereof and a hand gripping section toward the other end thereof;

(c) the ferrule member including a socket portion open at the other end thereof to receive the tool end section of the handle member;

(d) said tool end section being elongate to extend into the socket portion and including an outer circumferential surface having an inner end and an outer end, (e) shock absorbing means located intermediate the inner and outer ends of the tool end section along said outer circumferential surface, (f) said shock absorbing means being effective to provide a tightened fit between the ferrule member and the tool end section when the ferrule member is slidingly displaced over the outer circumferential surface of the tool end section, and (g) said shock absorbing means includes a resilient ring member movable along the outer circumferential surface of the tool end section.

2. A tool as defined in claim 1 wherein the tool end section includes an outer end abutment means to maintain the ring member on said tool end section.

3. A tool as defined in claim 2 wherein the outer end abutment means comprises a circumferential flange located at the outer end of the tool end section.

4. A tool as defined in claim 1 wherein the tool end section includes releaseable locking means having a manually actuatable member to release the ferrule member for removal of the ferrule member from the tool end section.

5. A tool as defined in claim 4 wherein the ferrule member includes an aperture and the actuatable member comprises a button element biassed outwardly from said outer circumferential surface to protrude through said aperture when said aperture is registered over said button element once the ferrule member is in a final operating position over said tool end section.

6. A tool as defined in claim 5 wherein said button element is movably disposed in a recess formed in the outer circumferential surface of the tool end section.

7. A tool as defined in claim 1 wherein the ferrule member includes tool member securing means located at said one end thereof to fixedly hold the tool member in place.

8. A tool as defined in claim 7 wherein said tool member securing means includes a fixture assembly for centering a shank portion of the tool member and epoxy resin material disposed around the fixture and shank portion within the ferrule member.

9. A hand tool having an interchangeable handle member, said tool comprising:

(a) a tool member fixedly disposed at one end of a ferrule member, (b) the handle member including a tool end section at one end thereof and a hand gripping section toward the other end thereof, (c) the ferrule member including a socket portion open at the other end thereof to receive the tool end section of the handle member, (d) said tool end section being elongate to extend into the socket portion and including an outer circumferential surface having an inner end and an outer end, (e) shock absorbing means located intermediate the inner and outer ends of the tool end section along said outer circumferential surface, (f) said shock absorbing means being effective to provide a tightened fit between the ferrule member and the tool end section when the ferrule member is slidingly displaced over the outer circumferential surface of the tool end section, and (g) said shock absorbing means includes a first resilient ring member defining a seating means at an inner end portion of the tool end section and a second resilient ring member movably disposed along an outer end portion of the tool end section to define a compressible ferrule tightening means.

10. A tool as defined in claim 9 wherein said first and second resilient ring members comprises O-rings composed of compressible material.

11. A tool as defined in claim 9 wherein said outer end portion is tapered inwardly toward the outer end of the tool end section with said second resilient ring member being an O-ring disposed therealong, and the first resilient ring member is an O-ring composed of compressible material and disposed in a circumferential grove formed in the outer circumferential surface of the tool section.

12. A hand tool having an interchangeable handle member, said tool comprising:

(a) a tool member fixedly disposed at one end of a ferrule member, (b) the handle member including a tool end section at one end thereof and a hand gripping section toward the other end thereof, (c) the ferrule member including a socket portion open at the other end thereof to receive the tool end section of the handle member, (d) said tool end section being elongate to extend into the socket portion and including an outer circumferential surface having an inner end and an outer end, (e) shock absorbing means located intermediate the inner and outer ends of the tool end section along said outer surface, (f) said shock absorbing means being effective to provide a tightened fit between the ferrule member and the tool end section when the ferrule member is slidingly displaced over the outer surface of the tool end section, (g) the tool end section includes releasable locking means for fixing the position of the ferrule in position once the elongate tool end section is firmly extended into the socket portion, (h) the releaseable locking means includes a button element pivotally disposed in an elongate recess formed in said outer surface of the tool end section and biassing means located onto the tool end section to urge one end of the button element outwardly with respect to the tool end section, (i) the biassing means includes an O-ring located in a circumferential groove and spanning the elongate recess, (j) said button element having one end attached to said spanning O-ring which urges said one end of the button element outwardly from the outside surface of the tool end section.

13. A hand tool having an interchangeable handle member, said tool comprising:

(a) a tool member fixedly disposed at one end of a ferrule member, (b) the handle member including a tool end section at one end thereof and a hand gripping section toward the other end thereof, (c) the ferrule member including a socket port at the other end thereof to receive the tool end section of the handle member, (d) said tool end section being elongate to extend into the socket portion and including an outer circumferential surface having an inner end and an outer end, (e) shock absorbing means located intermediate the inner and outer ends of the tool end section along said outer surface, (f) said shock absorbing means being effective to provide a tightened fit between the ferrule member and the tool end section when the ferrule member is slidingly displaced over the outer surface of the tool end section, (g) the ferrule member includes tool member securing means located at said one end thereof to fixedly hold the tool member in place, (h) said tool member securing means includes a fixture assembly for centering a shank portion of the tool member and epoxy resin material disposed around the fixture and shank portion within the ferrule member.

(i) said tool member securing means includes mechanical locking means for holding the epoxy resin in place when said resin is in a hardened condition.

14. A hand tool assembly comprising:

(a) a ferrule member having a tool member securing end for receiving a shank portion of a tool member, and a socket portion for receiving the tool end section of a handle member, and (b) a fixture assembly for centering said shank portion of a tool member within the tool member securing end of the ferrule, (c) said fixture aassembly including sealing means located around the entire assembly to prevent liquid adhesive means for leaking past the assembly once the assembly is in place within the tool member securing end, (d) said fixture assembly includes a base, a plurality of leg elements pivotally attached to the base, and guide means for setting the location of the leg elements in an upright position with respect to the base.

15. An assembly as defined in claim 14 wherein each leg element has a tool shank facing surface directed inwardly toward a longitudinal axis thereof and a ferrule facing surface directed outwardly away from said longitudinal axis;

said leg elements are effective to maintain a tool shank portion in a center position with respect to the ferrule member, and said base member has an abutment surface means for contacting a free end surface of a tool shank portion when the shank portion is inserted along said longitudinal axis.

16. An assembly as defined in claim 14 wherein the ferrule member includes mechanical locking means for holding the adhesive means in place when said adhesive means is in a hardened condition, said ferrule member has an inner surface that is substantially conically shaped and tapers outwardly from its longitudinal axis toward the open socket portion thereof.

17. An assembly as defined in claim 16 wherein said mechanical locking means includes projections extending inwardly from the inner surface of the ferrule member toward its said longitudinal axis.

18. A hand tool assembly comprising:

(a) a ferrule member having a tool member securing end for receiving a shank portion of a tool member, and a socket portion for receiving the tool end section of a handle member, and (b) a fixture assembly for centering said shank portion of a tool member within the tool member securing end of the ferrule, (c) said fixture assembly including sealing means located around the entire assembly to prevent liquid adhesive means from leaking past the assembly once the assembly is in place within the tool member securing end, (d) said fixture assembly including a base, a plurality of leg elements pivotally attached to the base, and guide means for setting the location of the leg elements in an upright position with respect to the base, (e) the base including a circumferential surface, and (f) said sealing means is disposed along said circumferential surface to prevent the fluid adhesive means from leaking between the base and the ferrule member when the fixture assembly is in an operative position in the ferrule member for receiving a tool shank portion therein.

19. An assembly as defined in claim 18 wherein the sealing means comprises a resilient O-ring member disposed around said circumferential surface.

20. A hand tool handle for a tool including a ferrule member having a socket portion open at one end thereof, said handle comprising:

(a) a handle member including a tool end section at one end thereof and a hand gripping section toward the other end thereof, (b) said tool end section being elongate to extend into the socket portion and including an outer surface having an inner end and an outer end, (c) compressible shock absorbing means located intermediate the inner and outer ends of the tool end section along said outer surface, (d) said shock absorbing means being effective to provide a tightened fit between the ferrule member and the tool end section when the ferrule member is slidingly displaced over the outer surface of the tool end section, (e) said shock absorbing means includes a compressible ferrule seating means located on said outer surface at an inner end portion of the tool end section and a compressible ferrule tightening means adjustably disposed at a location laterally displaced from said seating means toward the outer end of the tool end section, (f) said compressible ferrule tightening means includes a resilient ring means movably disposed along a longitudinal length of said outer circumferential surface.

21. A tool handle as defined in claim 20 wherein the resilient ring means comprises an O-ring composed of compressible material, and the tool end section includes an outer end abutment means to maintain the ring member on said tool end section.

22. A tool handle as defined in claim 21 wherein the outer circumferential surface of the tool end section tapers inwardly toward the outer end thereof, and said outer end abutment means comprises a circumferential flange located at the outer end of the tool end section.

23. A tool handle as defined in claim 22 wherein said tapered out circumferential surface is substantially circular in cross-section to form a conically shaped portion along said tool end section ending at said circumferential flange.

24. A tool handle as defined in claim 20 wherein the tool end section includes releasable locking means for fixing the position of the ferrule once the elongate tool end section is firmly extended into the socket portion.

25. A tool handle as defined in claim 24 wherein the releasable locking means includes a button element pivotally disposed in an elongate recess formed in said outer circumferential surface of the tool end section and biassing means located on the tool end section to urge one end of the button element outwardly with respect to the tool end section.

26. A tool handle as defined in claim 20 wherein said inner end of the tool end section is defined by a circumferential shoulder against which shoulder the ferrule member abuts when said ferrule member is in a final operating position along said outer circumferential surface.

27. A tool handle as defined in claim 20 wherein said handle member comprises a composite structure including a core member having a molded plastic outer coating over the core member.

28. A tool handle as defined in claim 27 wherein said hand gripping section is oval-shaped in cross-section with the major axis thereof in a plane which extends through the longitudinal central axis of the handle member and thereby extends symmetrically through a tool disposed thereon.

29. A tool handle as defined in claim 28 wherein the core member is hollow.

30. A tool handle as defined in claim 29 wherein the core member has an outer wall with a substantially uniform thickness around the entire periphery of the cross-section thereof and is composed of a strand material encased in a resinous material.

31. A hand tool handle for a tool including a ferrule member having a socket portion open at one end thereof, said handle comprising:

(a) a handle member including a tool end section at one end thereof and a hand gripping section toward the other end thereof, (b) said tool end section being elongate to extend into the socket portion and including an outer circumferential surface having an inner end and an outer end, (c) shock absorbing means located intermediate the inner and outer ends of the tool end section along said outer circumferential surface, (d) said shock absorbing means being effective to provide a tightened fit between the ferrule member and the tool end section when the ferrule member is slidingly displaced over the outer circumferential surface of the tool end section, (e) the tool end section includes releasable locking means for fixing the position of the ferrule once the elongate tool end section is firmly extended into the socket portion, (f) the releasable locking means includes a button element pivotally disposed in an elongate recess formed in said outer circumferential surface of the tool end section and biassing means located on the tool end section to urge one end of the button element outwardly with respect to the tool end section, (g) the biassing means includes an O-ring located in a circumferential groove and spanning the elongate recess, (h) said button element having one end attached to said spanning O-ring which urges one end of the button element outwardly from the outer circumferential surface of the tool end section.

* * * * *